US008556120B2

(12) United States Patent
Ando et al.

(10) Patent No.: US 8,556,120 B2
(45) Date of Patent: Oct. 15, 2013

(54) MEDICAL AGENT DISPENSER

(75) Inventors: Hiroshi Ando, Ehime (JP); Kaoru Shigematsu, Ehime (JP); Toshiki Matsumoto, Ehime (JP); Yuichi Sugiue, Ehime (JP)

(73) Assignee: Panasonic Corporation, Osaka (JP)

( * ) Notice: Subject to any disclaimer, the term of this patent is extended or adjusted under 35 U.S.C. 154(b) by 262 days.

(21) Appl. No.: 13/121,024

(22) PCT Filed: Mar. 25, 2010

(86) PCT No.: PCT/JP2010/002098
§ 371 (c)(1),
(2), (4) Date: Jun. 21, 2011

(87) PCT Pub. No.: WO2010/131407
PCT Pub. Date: Nov. 18, 2010

(65) Prior Publication Data

US 2011/0315705 A1 Dec. 29, 2011

(30) Foreign Application Priority Data

May 12, 2009 (JP) ..... 2009-115401

(51) Int. Cl.
*A61J 7/02* (2006.01)

(52) U.S. Cl.
USPC ..... 221/197; 221/12; 221/13

(58) Field of Classification Search
USPC ..... 221/9, 12, 13, 197
See application file for complete search history.

(56) References Cited

U.S. PATENT DOCUMENTS

| | | | | |
|---|---|---|---|---|
| 5,609,268 | A * | 3/1997 | Shaw | 221/2 |
| 6,439,422 | B1 * | 8/2002 | Papp et al. | 221/13 |
| 6,601,729 | B1 * | 8/2003 | Papp | 221/25 |
| 6,702,146 | B2 * | 3/2004 | Varis | 221/3 |
| 6,880,555 | B1 * | 4/2005 | Brunnberg et al. | 128/203.12 |
| 7,302,311 | B2 * | 11/2007 | Varis | 700/232 |
| 2006/0196504 | A1 | 9/2006 | Augustyn et al. | |
| 2007/0257051 | A1 * | 11/2007 | Abdulhay et al. | 221/2 |

FOREIGN PATENT DOCUMENTS

| | | |
|---|---|---|
| AU | 2004262907 | 2/2005 |
| CA | 2 533 333 | 2/2005 |
| EP | 1 220 698 | 7/2002 |
| JP | 2006-528500 | 12/2006 |
| WO | 01/26720 | 4/2001 |
| WO | 2005/014089 | 2/2005 |

OTHER PUBLICATIONS

International Search Report issued Jun. 22, 2010 in International (PCT) Application No. PCT/JP2010/002098.

* cited by examiner

*Primary Examiner* — Patrick MacKey
(74) *Attorney, Agent, or Firm* — Wendroth, Lind & Ponack, L.L.P.

(57) ABSTRACT

Disclosed is a technology of discharging, from a drug cartridge, a drug instructed to discharge, while managing a plurality of drugs stored in a drug cartridge. The technology makes it possible to correctly discharge the drugs even when the dosing order of the drugs is changed. A medical agent dispenser has: a main body case (1); an annular drug cartridge (2) which is housed in the main body case (1) and has a plurality of holders (3) at equal intervals in the longitudinal direction; a discharge mechanism (7) which discharges the drugs from the holders (3); and an input interface (6) which receives operations of leading the drug to be discharged. Based on the number of operations the input interface (6) has received, gears (4*a*, 4*b*), i.e., rotating mechanisms which rotationally transfer the drug cartridge (2), are controlled.

10 Claims, 17 Drawing Sheets

(a)

(b)

(a)

(b)

(a)

(b)

(b)

(a)

(b)

MEDICAL AGENT DISPENSER

TECHNICAL FIELD

The present invention relates to a medical agent dispenser that manages a plurality of drugs held in a drug cartridge, and automatically discharges from the drug cartridge a drug for which a discharge command has been received.

BACKGROUND ART

With a conventional medical agent dispenser, a drug cartridge is inserted which holds one tablet of each drug, and when drug discharge commands are received, the drug cartridges are opened up one at a time starting from an end of the drug cartridge, until all of the drugs held in the drug cartridge have been discharged (see, for example, Patent Literature 1).

CITATION LIST

Patent Literature

Patent Literature 1: Japanese Unexamined Patent Application Publication (Translation of PCT Application) No. 2006-528500

SUMMARY

This prior art can be effective as long as the user is only using one type of drug. However, patients today often take a number of different kinds of drug, which are to be taken at different times of day. In such a case, for example, the type and quantity of drugs to be taken in the morning, at noon, in the evening, and before bed can be quite confusing.

This prior can be used to discharge drugs so as to accommodate such situations, but the following problems are encountered.

If the user should for some reason skip one dose, so that the drug is not dispensed, then the drug that is dispensed at the next scheduled time will not be the desired one. Therefore, the user had to dispense drugs that would not be taken, until the desired drug came around in the dispensing order again. These dispensed drugs were unnecessary. Therefore, a problem with prior art was that the proper drug could not be dispensed if the drug administration order were disrupted.

In view of this, it is an object of the present invention to provide a medical agent dispenser with which the proper drug can be dispensed even if the drug administration order should be disrupted.

To achieve the stated object, the medical agent dispenser of the present invention comprises a main body case, a discharge mechanism, a rotation mechanism, an input interface, and a controller. The discharge mechanism discharges the desired drug from one of a plurality of holders that hold drugs and are disposed equally spaced in the lengthwise direction of an annular drug cartridge installed inside the main body case. The rotation mechanism rotationally moves the annular drug cartridge. The input interface is operated to bring about drug discharge processing by the discharge mechanism. The controller controls the rotational movement of the drug cartridge on the basis of number of times the input interface is operated.

Advantageous Effects

With the medical agent dispenser of the present invention, just the desired drug can be properly discharged even if the drug administration order should be disrupted. Thus, there is no need to discharge unnecessary drugs even if the user should skip taking a drug because of testing or the like. As a result, the user can be prevented from taking the wrong drug.

DESCRIPTION OF EMBODIMENTS

Embodiments pertaining to the medical agent dispenser of the present invention will now be described in detail along with the drawings.

Embodiment 1

Figure 1:
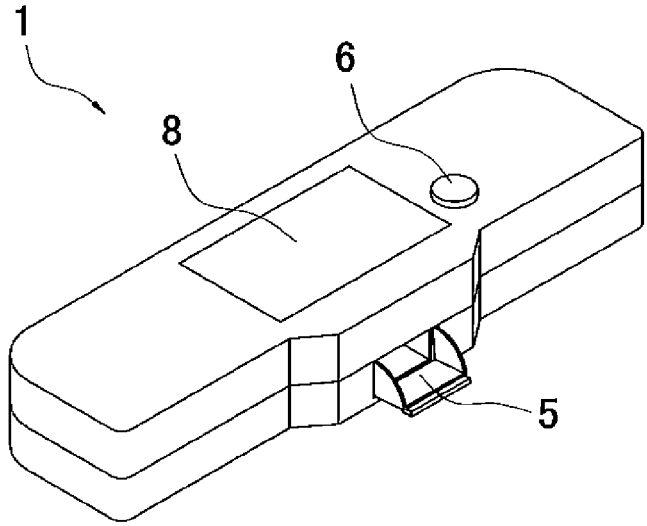
FIG. 1*a* is an overall oblique view of the configuration of the medical agent dispenser pertaining to Embodiment 1.
FIG. 1*b* is an exploded oblique view of FIG. 1*a;*
Figure 1:
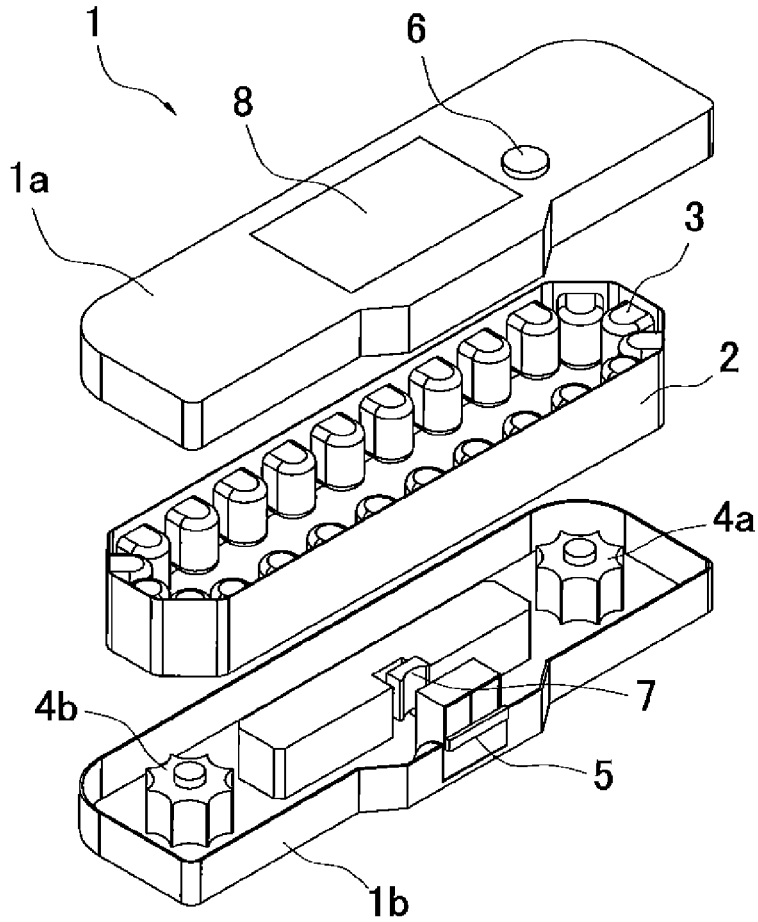

FIGS. 1*a* and 1*b* show the configuration of the medical agent dispenser in this embodiment. FIG. 1*a* shows the outside of the medical agent dispenser, and FIG. 1*b* shows the constituent elements of the medical agent dispenser.

As shown in FIGS. 1*a* and 1*b*, the medical agent dispenser comprises a main body case 1 and an annular drug cartridge 2 disposed inside the main body case 1.

The drug cartridge 2 has a plurality of holders 3 provided equally spaced in the lengthwise direction of a film formed in an annular shape. One or more drugs are contained in these holders 3.

The main body case 1 has a separable upper shell 1*a* and a lower shell 1*b*.

The upper shell 1*a* has on its upper face a command button (input interface) 6 that receives drug discharge commands from the user, and a display section 8 that displays prescription information for the discharged drug and so forth.

The lower shell 1*b* has gears 4*a* and 4*b* that engage with the holders 3 of the drug cartridge 2 and rotate the drug cartridge 2, and an openable and closeable discharge port 5 through which drugs are discharged to outside the main body case 1. When the discharge of a drug is directed by the user with the command button 6 provided to the upper shell 1*a*, the gears 4*a* and 4*b* rotate and move the drug cartridge 2 annularly, and the holder 3 containing the desired drug is positioned at the front face of the discharge port 5.

Figure 2:
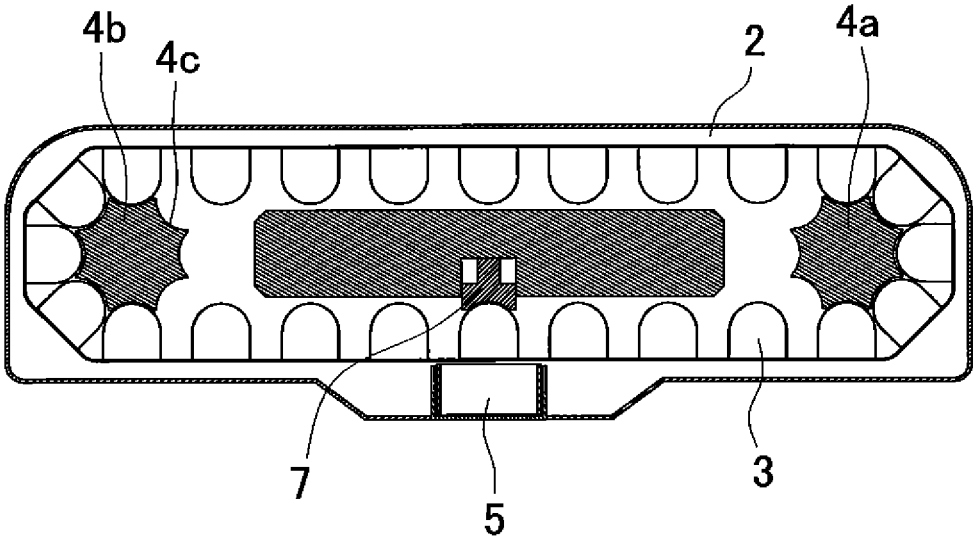
FIG. 2 is an interior cross section illustrating a state in which a drug cartridge has been inserted into the lower shell of the medical agent dispenser in FIG. 1.

FIG. 2 shows a state in which the drug cartridge 2 has been inserted into the lower shell 1*b*.

As shown in FIGS. 1*b* and 2, the lower shell 1*b* further has a drug ejector 7 further to the inner peripheral side than the mounted drug cartridge 2, at a position opposite the discharge port 5. The drug ejector 7 operates in conjunction with the operation of the command button 6 or the opening or closing of the discharge port 5. When a drug is to be discharged, the drug ejector 7 moves from the inner peripheral side of the lower shell 1*b* toward the discharge port 5 disposed on the outer peripheral side, and operates so as to apply pressure to the holder 3.

The gears 4*a* and 4*b* provided to the lower shell 1*b* will now be described.

As shown in FIG. 2, the gears 4*a* and 4*b* are provided with grooves 4*c* in its surface, which are substantially arc-shaped in cross sectional view, so as to mesh with the convex portions of the holders 3 protruding to the inner peripheral side in a state in which the drug cartridge 2 has been mounted in the lower shell 1*b*. The gears 4*a* and 4*b* are driven by a motor (not shown) and rotate clockwise and counter-clockwise, so that the drug cartridge 2 rotates in a circle. Drive force from a motor may be imparted to both of the gears 4*a* and 4*b* here, or may be imparted to just one of them, with the other gear rotating freely.

Figure 3:
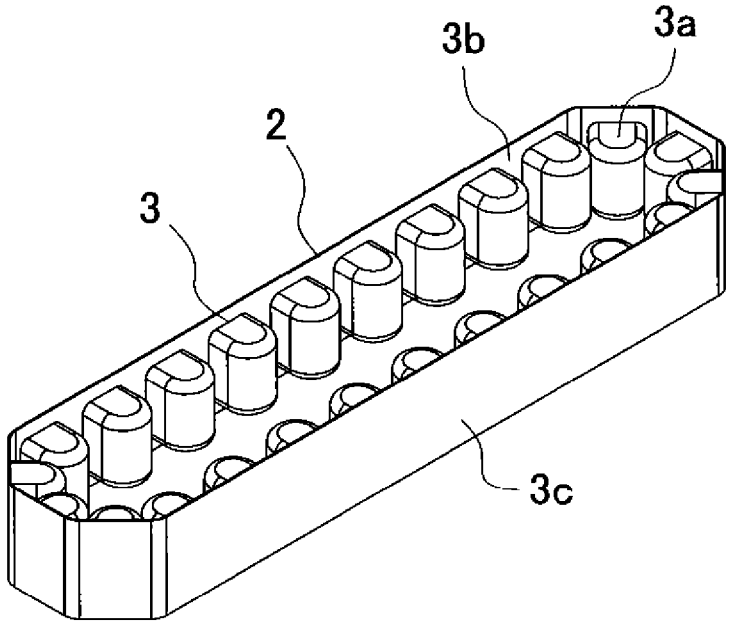
FIG. 3*a* is an oblique view of the configuration of the drug cartridge installed in the medical agent dispenser of FIG. 1*a*.
FIG. 3*b* is a schematic diagram of the drug holding portion of the drug cartridge in FIG. 3*a;*
Figure 3:
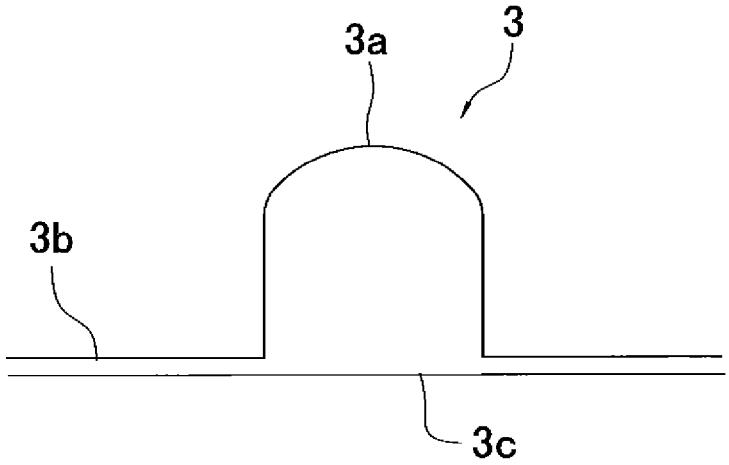

Next, the drug cartridge 2 will be described through reference to FIGS. 3*a* and 3*b*. FIG. 3*a* is an oblique view of the drug cartridge 2, and FIG. 3*b* is a partial cross section thereof.

The drug cartridge 2 has holder outer shells 3*a* that constitute the outer shells of the holders 3, a linking portion 3*b* that links the outer shells 3*a* in an annular shape, and a sealing film 3*c* that is stuck onto the outer peripheral face.

The holders 3 are spaces bounded by the outer shells 3*a* and the sealing film 3*c*, and one or more drugs are sealed inside each of these spaces.

The outer shells 3*a* and the linking portion 3*b* are molded integrally. ABS or another such resin is used for the molding material thereof, so that they are flexible and bend easily. Accordingly, as shown in FIG. 3*a*, the drug cartridge 2 is formed in an annular shape in the lengthwise direction, and can be rotated in this shape. Furthermore, the outer shells 3*a* are designed so that when the drug ejector 7 presses them in the direction of the sealing film 3*c*, the outer shells 3*a* can be readily deformed and crushed. It is also preferable for the outer shells 3*a* to have enough elasticity that they will return to their original shape in a state in which the drug ejector 7 has retracted is not pressing on them.

The sealing film 3*c* is formed from a metal thin film of aluminum or the like. The sealing film 3*c* is stuck onto the outer peripheral face side of the linking portion 3*b* with an adhesive agent or the like, and blocks and seals the open portion of the holders 3. When the outer shells 3*a* are crushed by movement of the drug ejector 7, this sealing film 3*c* is pushed out and torn by the drug sealed inside. Consequently, the desired drug can be discharged from the drug cartridge 2 by movement of the drug ejector 7.

The outer shells 3*a* and the sealing film 3*c* are preferably formed from a material that does not transmit substances that would denature the drug, such as moisture or oxygen. Furthermore, the outer shells 3*a* are preferably formed from a transparent or semi-transparent material so that the number and type of drugs sealed in the drug cartridge 2 can be checked. However, when drugs are sealed in which need to be kept away from light, the outer shells 3*a* must be opaque.

Next, the rotational control of the drug cartridge 2 inside the main body case 1 will be described.

A single dose of drug is sealed in each of the holders 3, and the holders 3 are arranged in the order in which the user is to take the drugs. For example, the holders 3 are arranged in the order of after breakfast, after lunch, after dinner, and before bed. The medical agent dispenser needs to recognize the orientation in which the drug cartridge 2 is inserted and the position of the holder 3 to be discharged first (that is, the front position), so that the drugs will be discharged properly in this order. One possible way to accomplish this is to specify the orientation and front position of the drug cartridge 2 and direct the user to insert the cartridge in the correct position, but it is more convenient if the apparatus automatically identifies these regardless of which way the user inserts the drug cartridge 2, and this is preferable from a safety standpoint because it prevents the wrong drug from being taken.

Figure 4:
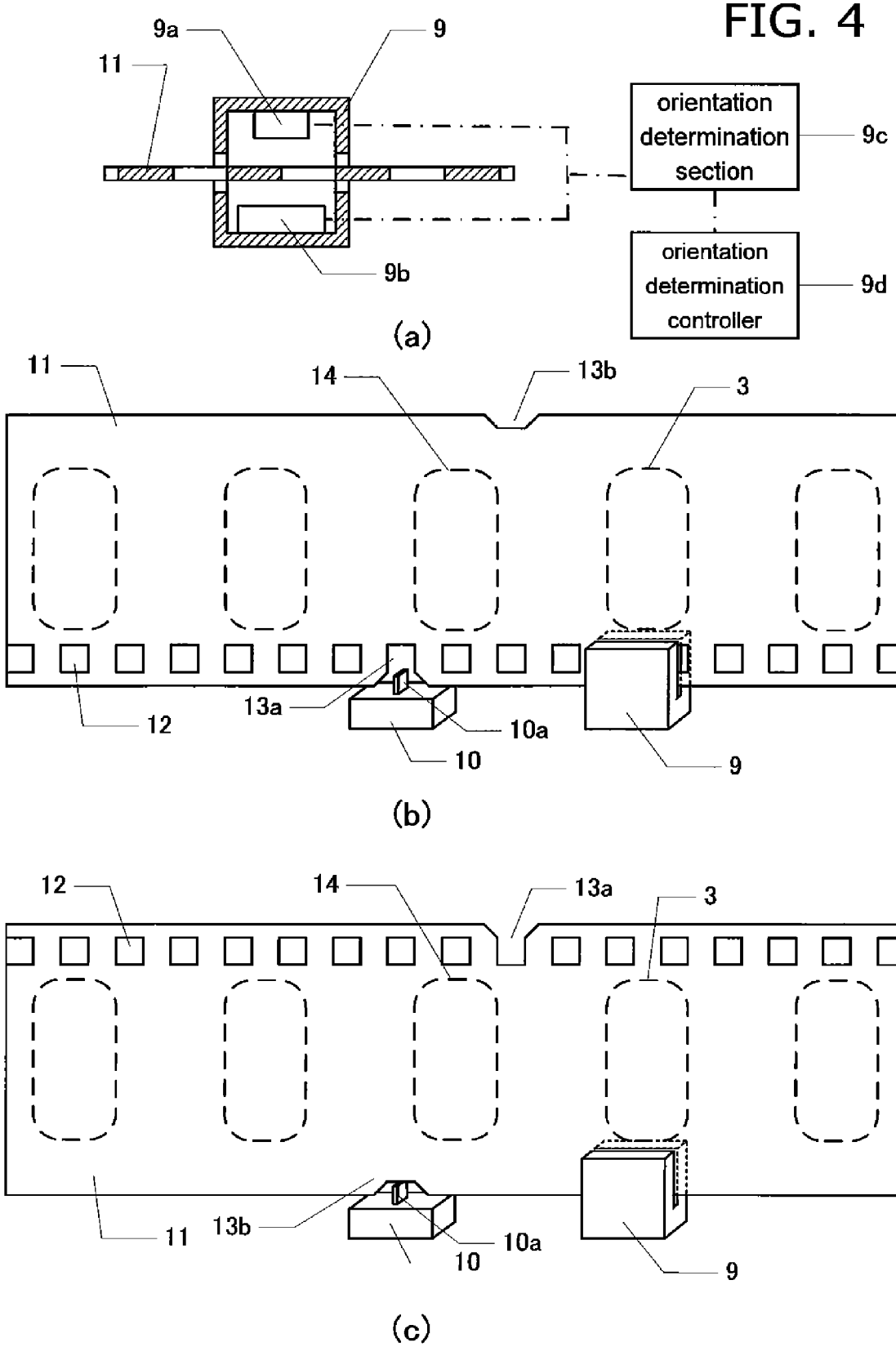
FIG. 4*a* is a cross section of the configuration of a cartridge orientation detector.
FIGS. 4*b* and 4*c* are oblique views of the peripheral configuration of the drug cartridge.
Figure 5:
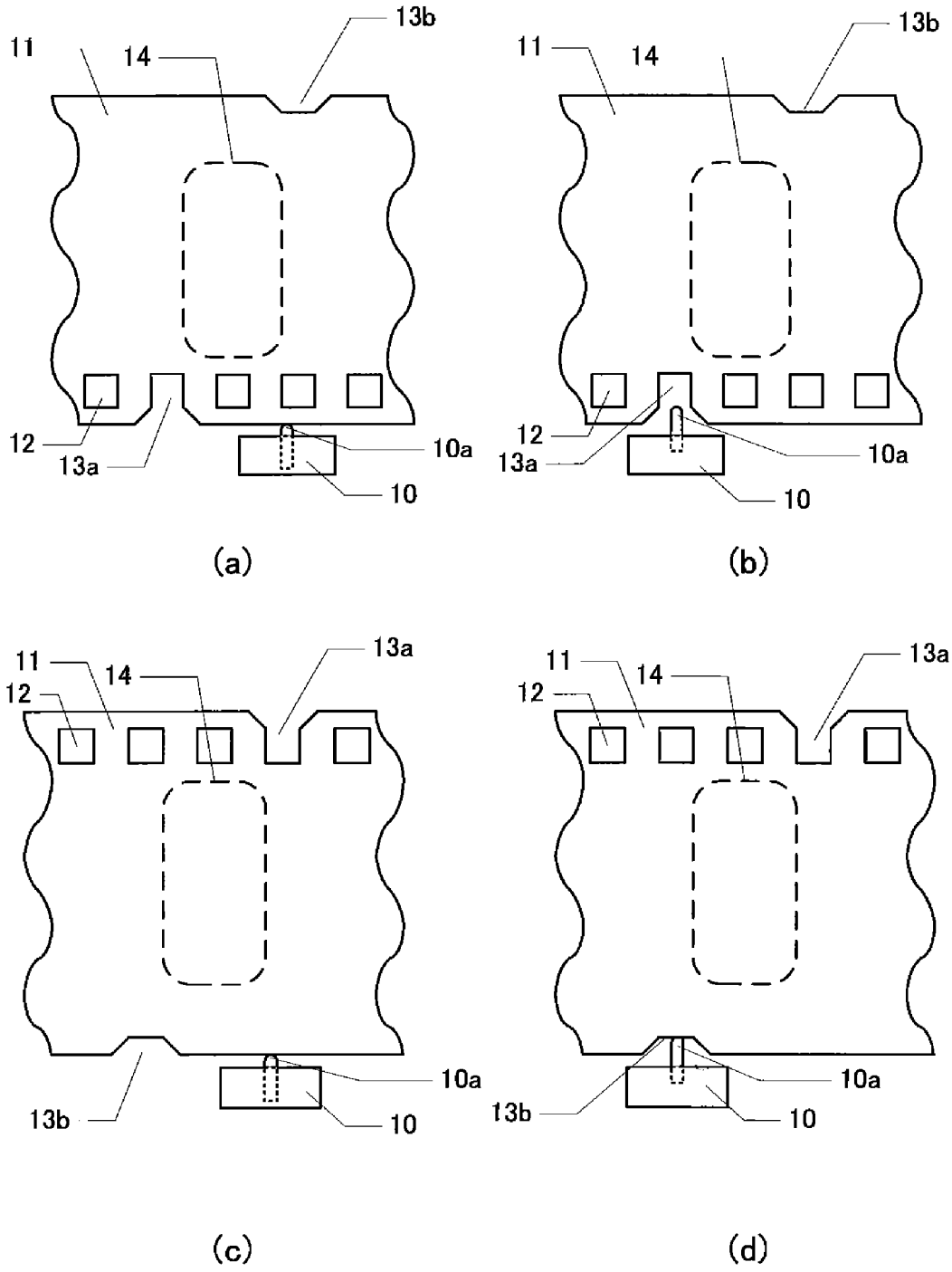
FIGS. 5*a* to 5*d* are diagrams illustrating the positional relation of the front portion of the drug cartridge to a cartridge distal end position detector.

In view of this, the medical agent dispenser in this embodiment, as shown in FIGS. 4*a* to 4*c*, further comprises a cartridge orientation detector 9 that detects the orientation of the drug cartridge 2, and a cartridge front position detector 10 that detects the front position of the drug cartridge 2 (the position of the holder 3 containing the drug that is supposed to be discharged first).

The cartridge orientation detector 9 may be disposed at a position touching the end of the annular drug cartridge 2 in its width direction (the up and down direction in FIG. 3*a*) inside the upper shell 1*a* or the lower shell 1*b*. In particular, it is preferable that the cartridge orientation detector 9 is disposed at a position near the gears 4*a* and 4*b* so that there will be no malfunction due to sagging of the drug cartridge 2 or the like.

Also, the cartridge front position detector 10 is preferably disposed near the discharge port 5 so that it will be easier to adjust the front position of the holders 3 of the drug cartridge 2.

FIGS. 4*a* to 4*c* show the configuration of the cartridge orientation detector 9, the cartridge front position detector 10, and a drug cartridge 11 corresponding to these. FIG. 4*a* is a top cross section of the cartridge orientation detector 9, FIG. 4*b* is a view of the drug cartridge 11 inserted in the "forward" direction, and FIG. 4*c* is a view of the drug cartridge 11 inserted in the "backward" direction. FIGS. 4*a* to 4*c* and FIG. 5 (discussed below) are all diagrams of the drug cartridge 11 as seen from the opposite side of the holders 3, so the positions of the holders 3 are indicated by dotted lines.

The cartridge orientation detector 9 has a light emitter 9*a* and a light receiver 9*b* that are opposite each other with the drug cartridge 11 in between. That is, if there is no obstruction between the light emitter 9*a* and the light receiver 9*b*, the positional relation is such that the light receiver 9*b* receives light emitted from the light emitter 9*a*. The cartridge orientation detector 9 further has an orientation determination section 9*c* and an orientation determination controller 9*d*.

The drug cartridge 11 has direction detection openings 12 aligned equally spaced in the lengthwise direction of the approximately circular shape. These direction detection openings 12 are provided to only one end in the width direction of the drug cartridge 11.

The orientation determination controller 9*d* controls the light emitter 9*a*, the light receiver 9*b*, and the orientation determination section 9*c* and determines the orientation of the drug cartridge 11 when the drug cartridge 11 has been inserted into the main body case 1 and the upper shell 1*a* and lower shell 1*b* put together, or when the power is switched on after this.

More specifically, first the orientation determination controller 9*d* causes the light emitter 9*a* to emit light, and outputs the amount of light received by the light receiver 9*b* from the light receiver 9*b* to the orientation determination section 9*c*. The orientation determination section 9*c* determines the orientation of the drug cartridge 11 on the basis of this output result.

In determining orientation, the orientation determination section 9*c* compares the amount of received light as outputted from the light receiver 9*b* with a specific threshold, according to a command from the orientation determination controller 9*d*. If the amount of received light is below the threshold, it is determined that the drug cartridge 11 has been mounted backward, and if the amount of received light is over the threshold, it is determined that the drug cartridge 11 has been mounted in the proper direction.

Specifically, as shown in FIG. 4*b*, when the drug cartridge 11 is inserted in the forward direction, at least one of the direction detection openings 12 will overlap the cartridge orientation detector 9. Accordingly, the proper mounting of the drug cartridge 11 can be detected by using the light receiver 9*b* to detect the light from the light emitter 9*a* that has passed through the direction detection opening 12.

Meanwhile, as shown in FIG. 4*c*, if the drug cartridge 11 is accidentally mounted in the backward direction, the space between the light emitter 9*a* and the light receiver 9*b* inside the cartridge orientation detector 9 will be blocked by the drug cartridge 11. Therefore, almost none of the light emitted from the light emitter 9*a* will reach the light receiver 9*b*.

Consequently, the insertion direction of the drug cartridge 11 can be easily detected on the basis of the difference in the amount of light received by the light receiver 9*b*. To accurately detect whether or not the drug cartridge 11 has been properly mounted, the light radiation/light reception range of the light emitter 9*a* and the light receiver 9*b* is preferably set to be relatively wider than the gaps between the direction detection openings 12.

The cartridge front position detector 10 has a detector switch 10*a*. With the cartridge front position detector 10, the output is high when the detector switch 10*a* is pushed to the main body side of the cartridge front position detector 10, and the output is low when the switch is not being pushed. The detector switch 10*a* normally protrudes from the main body of the cartridge front position detector 10, and is biased in the protruding direction so as to move only when in contact with something.

As shown in FIGS. 4*b* and 4*c*, the drug cartridge 11 is provided with front position marks 13*a* and 13*b* for detecting the front position. The front position marks 13*a* and 13*b* are disposed at the ends of the drug cartridge 11 in its width direction so as to flank the front holder 14.

Of the plurality of holders 3 had by the drug cartridge 11, the front holder 14 here is the one at the starting point of the holder 3 containing the drug that is supposed to be taken first. For instance, a drug is sealed in that is to be taken after breakfast on the first day. The front position mark 13*a* is formed as a single cut-out portion that communicates with one of the direction detection openings 12.

The front position marks 13*a* and 13*b* are simple cut-outs with a substantially trapezoidal shape, and the position of the front holder 14 is detected when the detector switch 10*a* goes into a cut-out portion.

The method for detecting the position of the front holder 14 with the detector switch 10*a* will now be described through reference to FIGS. 5*a* to 5*d*. These drawings are detail views of the area of the drug cartridge 11 around the front holder 14. FIGS. 5*a* and 5*b* show the state when the drug cartridge 11 has been properly mounted in the forward direction, and FIGS. 5*c* and 5*d* show the state when the drug cartridge 11 has been accidentally inserted in the backward direction.

FIGS. 5*a* and 5*c* shown the state when the drug cartridge 11 is not located at the specified initial position. In this case, as shown in the drawings, the detector switch 10*a* hits the end face of the drug cartridge 11, and is pushed into the main body of the cartridge front position detector 10. At this point the cartridge front position detector 10 outputs at high.

On the other hand, FIGS. 5*b* and 5*d* show the state when the drug cartridge 11 has moved to the specified initial position. In this case, the detector switch 10*a* is at the position of the front position mark 13*a* or the front position mark 13*b*, and is not pushed into the main body of the cartridge front position detector 10. At this point the cartridge front position detector 10 outputs at low.

In this embodiment, the rotation of the drug cartridge 11 is controlled on the basis of output information from the above-mentioned cartridge orientation detector 9 and cartridge front position detector 10.

Figure 6:
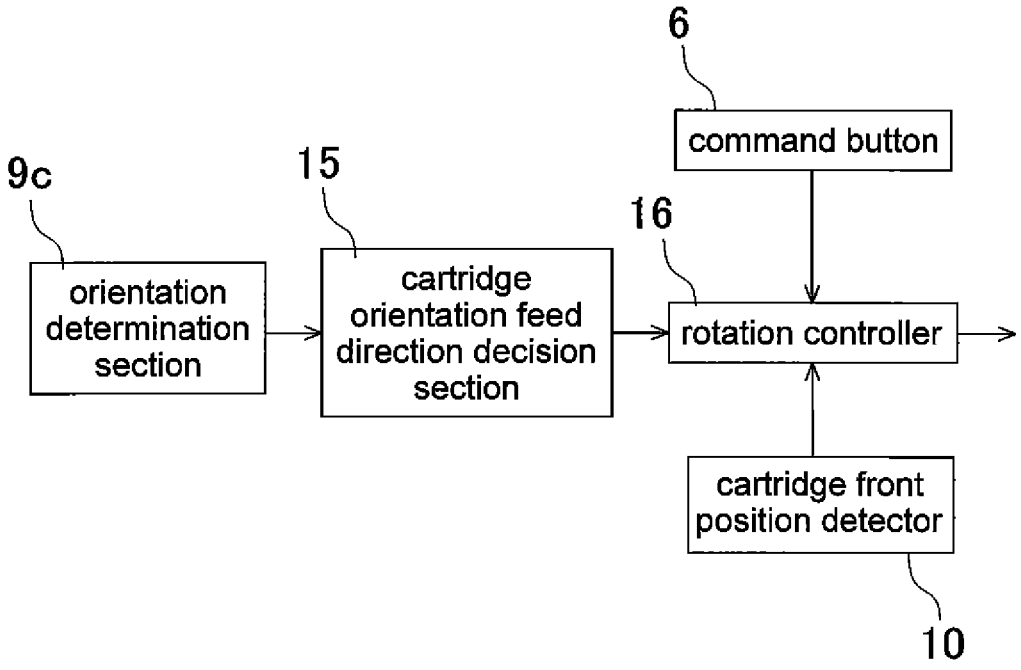
FIG. 6 is a signal block diagram of a logic circuit installed in the medical agent dispenser of FIG. 1.
Figure 7:
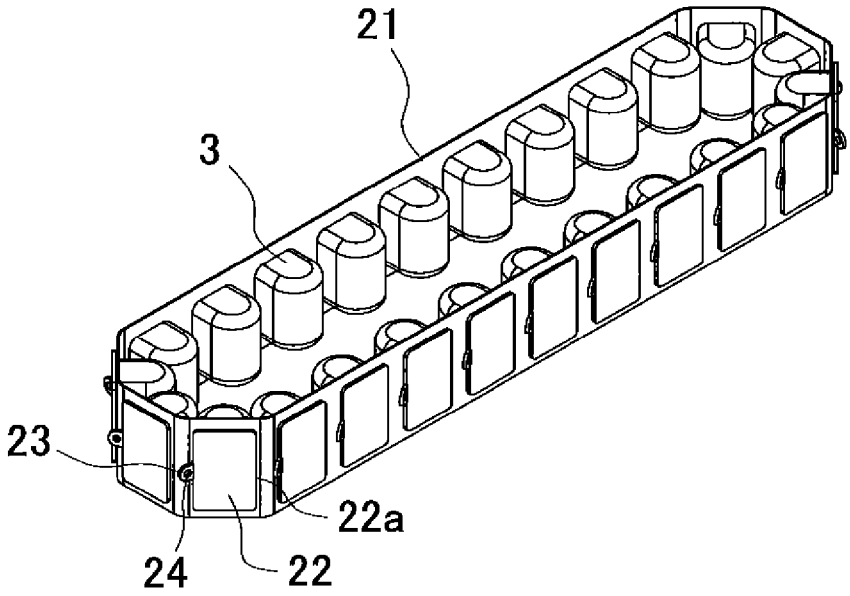
FIG. 7*a* is an overall oblique view of the configuration of the medical agent dispenser pertaining to Embodiment 2.
FIG. 7*b* is a cross section of the interior configuration of a medical agent dispenser in which the drug cartridge of FIG. 7*a* has been installed.
Figure 7:
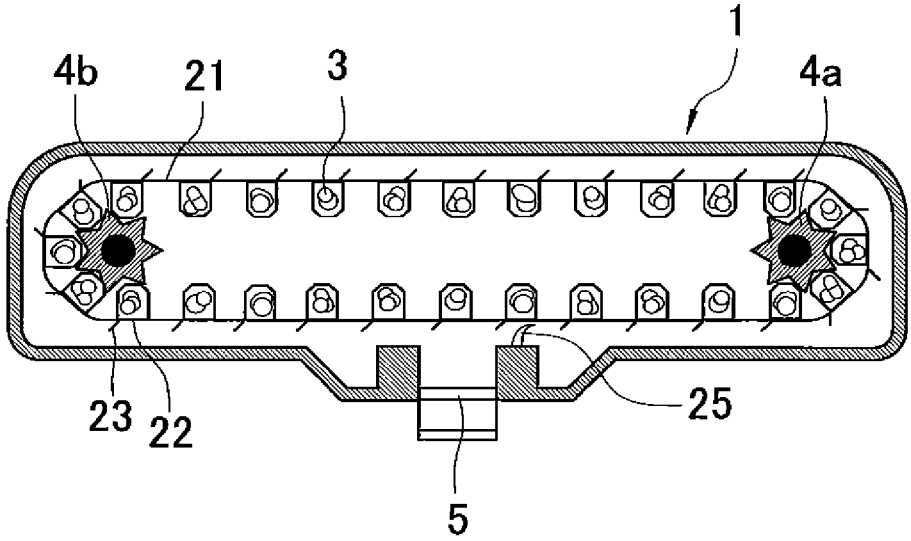

Accordingly, as shown in FIG. 6, a cartridge feed direction decision section 15 to which signals from the orientation determination section 9*c* are inputted, and a rotation controller (controller) 16 to which signals from the command button 6, the cartridge front position detector 10, and the cartridge feed direction decision section 15 are inputted are disposed within the main body case 1. The cartridge feed direction decision section 15 and the rotation controller 16 are logic circuits such as a signal processor IC, for example.

FIG. 6 is a signal block diagram of these logic circuits.

The cartridge feed direction decision section 15 decides the feed direction of the drug cartridge 11, that is, the rotation direction of the gears 4*a* and 4*b*, upon receipt of a signal from the orientation determination section 9*c* indicating the result of detecting whether the drug cartridge 11 has been mounted in the forward direction or the backward direction. The rotation direction of the gears 4*a* and 4*b*, which are used to feed the drug cartridge 11 in the dose direction, is then outputted to the rotation controller 16 as a reference signal for the forward feed direction.

The rotation controller 16 first refers to a signal outputted by the cartridge front position detector 10 when the drug cartridge 11 has been mounted in the lower shell 1*b* of the main body case 1 and the upper shell 1*a* and the lower shell 1*b* have been put together. If this signal is at the high level, it is determined that the drug cartridge 11 is not in the specified initial position. A driven signal is then outputted to the motor (not shown) that rotates the gears 4*a* and 4*b*, so that the drug cartridge 11 will be feed in the forward feed direction indicated by the cartridge feed direction decision section 15.

If the rotation controller 16 detects that the signal outputted by the cartridge front position detector 10 has changed from high to low, drive of the motor (not shown) is stopped. The motor installed in the medical agent dispenser here to precisely control this rotation and stopping is preferably a stepping motor, for example.

When the cartridge front position detector 10 is at a position away from the discharge port 5, the positional relation between the discharge port 5 and the front holder 14 is recognized, and it is detected that the signal outputted by the cartridge front position detector 10 has changed from high to low, after which the motor is rotated and the position of the drug cartridge 11 is adjusted so that the front holder 14 will move to the position of the discharge port 5.

After the drug cartridge 11 has been rotationally moved to the specified initial position, the rotation controller 16 outputs a drive signal to rotationally drive the motor in the forward feed direction every time a signal from the command button 6 arrives. The amount of rotational drive of the motor here is an amount approximately equal to one holder 3.

When the command button 6 is pressed twice within a short span, a drive signal is outputted to rotationally drive the motor an amount equal to two holders 3. This assumes a case such as when the user skips his dose after lunch, and wants to dispense the drug to be taken after dinner, right after the one to be taken after breakfast. With the medical agent dispenser of this embodiment, the user can tell the apparatus to move by three or four holders 3 according to how many times the command button 6 is pushed.

Then, if it is detected that the signal outputted by the cartridge front position detector 10 has again changed from high to low when the rotation controller 16 is performing control to move the drug cartridge 11 in conjunction with the command button 6, it is determined that the drug cartridge 11 has gone all the way around once, that is, that the specified amount has been discharged. The rotation controller 16 then outputs a signal to the display section 8 to display a message prompting the user to replace the drug cartridge 11.

As discussed above, with the medical agent dispenser in this embodiment, when the holders 3 of the drug cartridge 11 have been fed one after the other to be positioned at the discharge port 5, if a specific signal is received from the command button 6, such as a signal outputted when the command button 6 is held down, control is performed so that the drug ejector 7 presses on the holder 3 from the inner peripheral side and the drug sealed in the holder 3 is discharged from the discharge port 5.

Consequently, this results in an annular drug cartridge in which holders containing single-dose drugs are linked in the lengthwise direction, and an apparatus with which this drug cartridge is rotated by the required amount to discharge the desired drug, so the proper drug can be discharged even if the drug administration order should be disrupted.

In this embodiment, the drug ejector 7 was provided as a mechanism for discharging the drugs, but the present invention is not limited to this. For example, instead of the drug ejector 7, a member such as a hook or the like that rips the sealing film 3*c* in conjunction with the opening and closing of the discharge port 5 may be provided near the discharge port 5.

Embodiment 2

The medical agent dispenser pertaining to another embodiment of the present invention will now be described through reference to FIGS. 7*a* to 10*f*.

FIG. 7*a* is an oblique view of a drug cartridge 21, and FIG. 7*b* is a top cross section of the medical agent dispenser.

In this Embodiment 2, instead of using the drug ejector 7 from Embodiment 1 as above, a hook (first hook, discharge mechanism, opening member) 25 is provided near the discharge port 5 as an opening member that opens covers 22 by hooking onto part of the covers 22, which are used to discharge drugs provided to the various holders 3 of the drug cartridge 21. It is in this respect that Embodiment 2 differs from Embodiment 1.

In other words, in Embodiment 1 above the drug ejector 7 was used as the discharge mechanism for discharging the drug from the drug cartridge, but in Embodiment 2 here the rotation controller 16 (controller, discharge mechanism) that controls the rotation direction of the hook 25 and the drug cartridge 21 is used as the discharge mechanism.

Therefore, those components that have the same function as in Embodiment 1 above are numbered the same and will not be described again.

With the medical agent dispenser in Embodiment 2, as shown in FIG. 7*a*, the drug cartridge 21 having the holders 3, the covers 22, tabs 23, and hole portions 24 is installed.

The covers 22, the tabs 23, and the hole portions 24 are provided on the outer peripheral face side of each of the plurality of holders 3. The covers 22 are stuck onto each of the holders 3 and seal up the holders 3 so as to block the open portion on the outer peripheral face side of the holders 3.

The tabs 23 are provided to one end of the covers 22, and have a shape that sticks out slightly from the outer peripheral face of the annular drug cartridge 21.

The ends 22*a* of the covers 22 on the opposite side from the tabs 23 are securely bonded to the outer peripheral face of the drug cartridge 21, or are integrated with the outer peripheral face of the drug cartridge 21, formed such that the covers 22 will not come off of the drug cartridge 21. The three sides of the substantially quadrangular covers 22 other than the ends 22*a* are bonded with a pressure-sensitive adhesive substance to the outer peripheral face of the drug cartridge 21. The peel strength between the outer peripheral face of the drug cartridge 21 and the three sides of the covers 22 other than the side where the ends 22*a* are located is low enough that the tabs 23 can be peeled back when pulled.

The hole portions 24 are through-holes provided in the approximate center of the substantially circular tabs 23. The diameter of the hole portions 24 is slightly larger than the distal ends of the hook 25 (see FIG. 7*b*) provided on the main body case 1 side.

As shown in FIG. 7*b*, the main body case 1 in which the drug cartridge 21 is installed has substantially the same configuration as that in Embodiment 1 above, but has the hook 25 for peeling back the covers 22, instead of the drug ejector 7, as the discharge mechanism.

Figure 8:
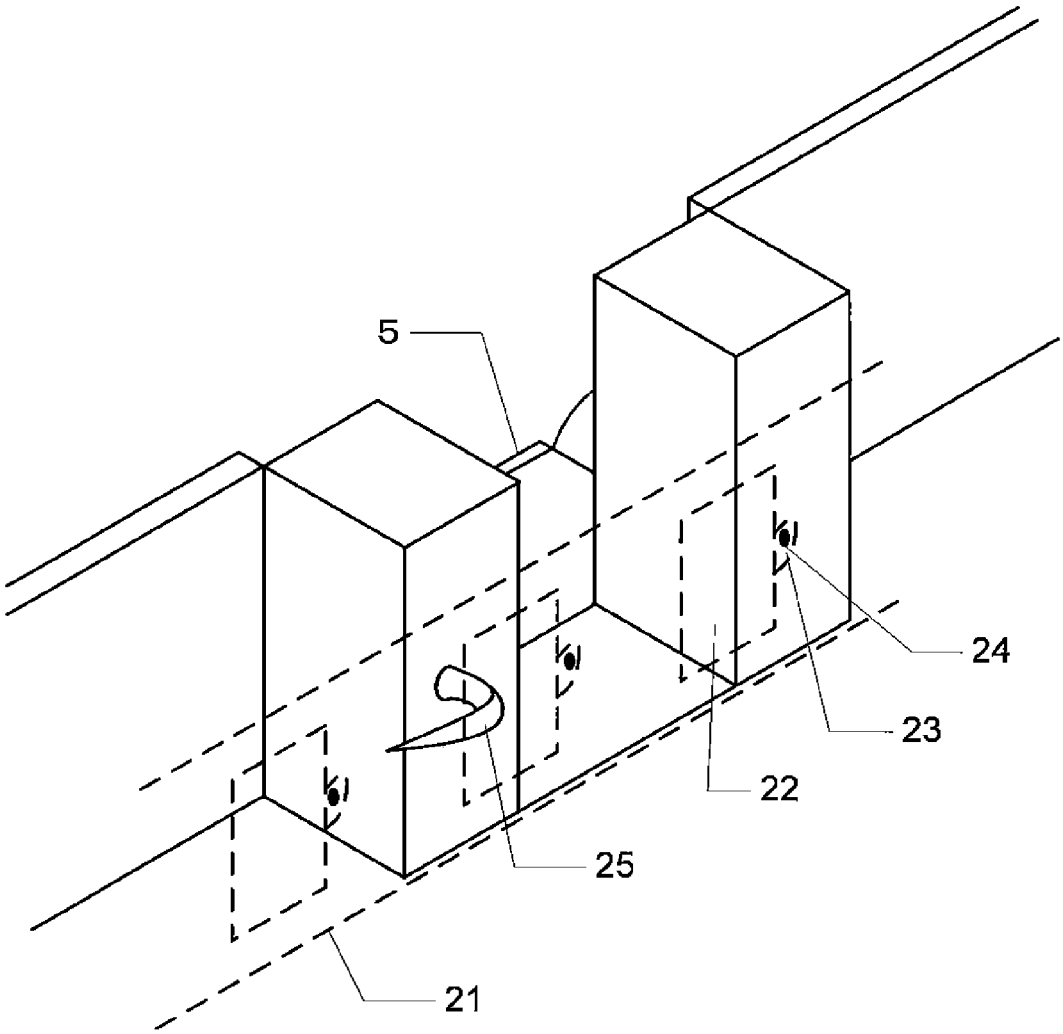
FIG. 8 is a detail view of the area near the discharge port of the medical agent dispenser in FIG. 7*a;*
Figure 9:
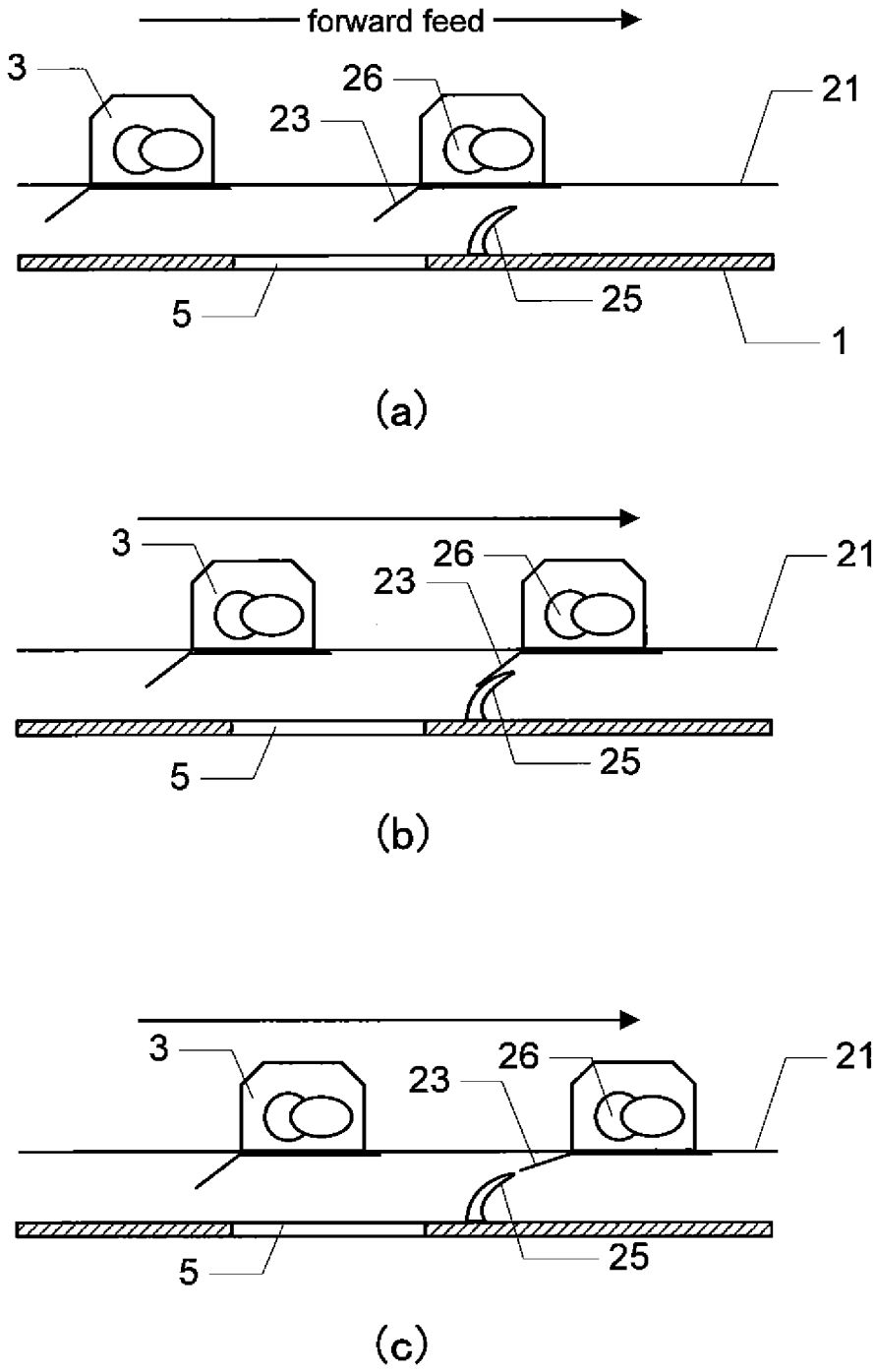
FIGS. 9*a* to 9*c* are diagrams illustrating the relation between the hook of the medical agent dispenser and the covers of the drug cartridge.
Figure 10:
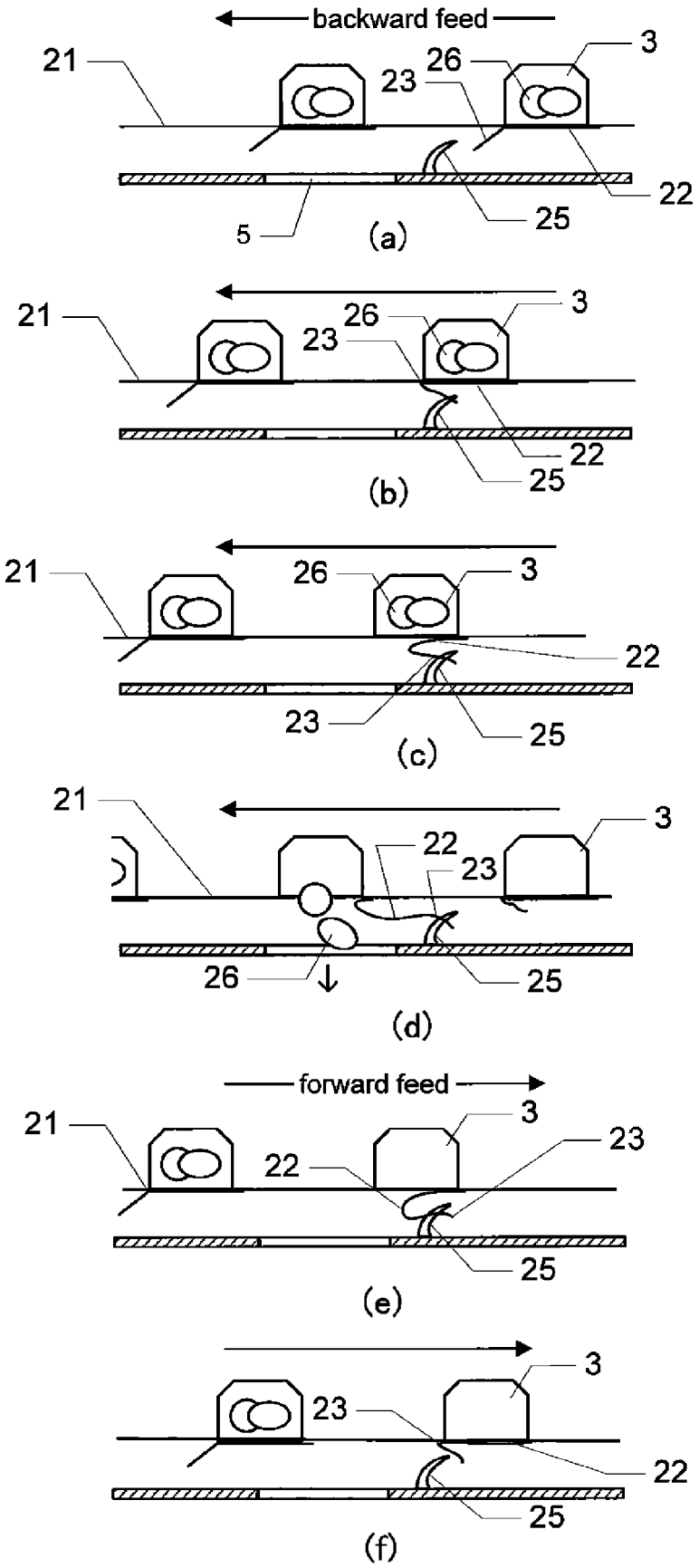
FIGS. 10*a* to 10*f* are diagrams illustrating the relation between the hook of the medical agent dispenser and the covers of the drug cartridge.
Figure 11:
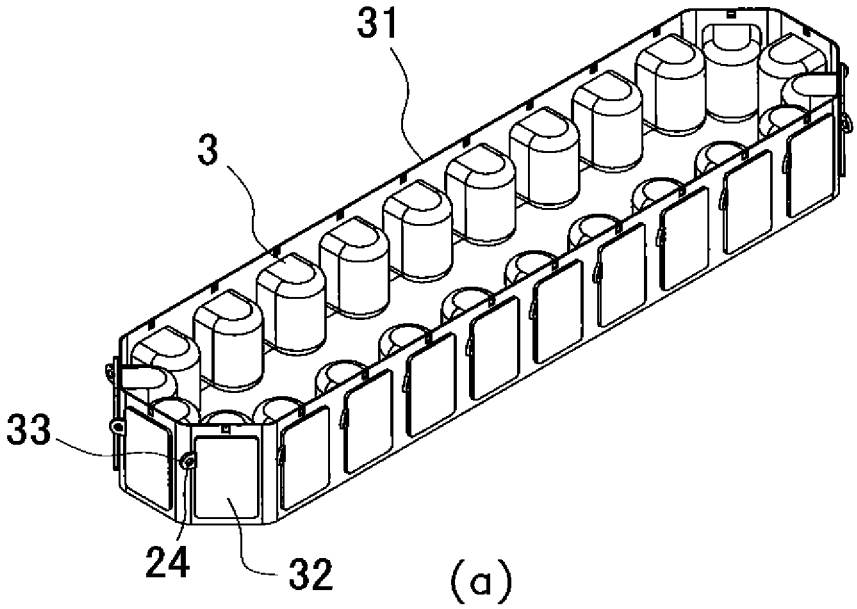
FIG. 11*a* is an overall oblique view of the configuration of the medical agent dispenser pertaining to Embodiment 3.
FIG. 11*b* is a cross section of the interior configuration of a medical agent dispenser in which the drug cartridge of FIG. 11*a* has been installed.
Figure 11:
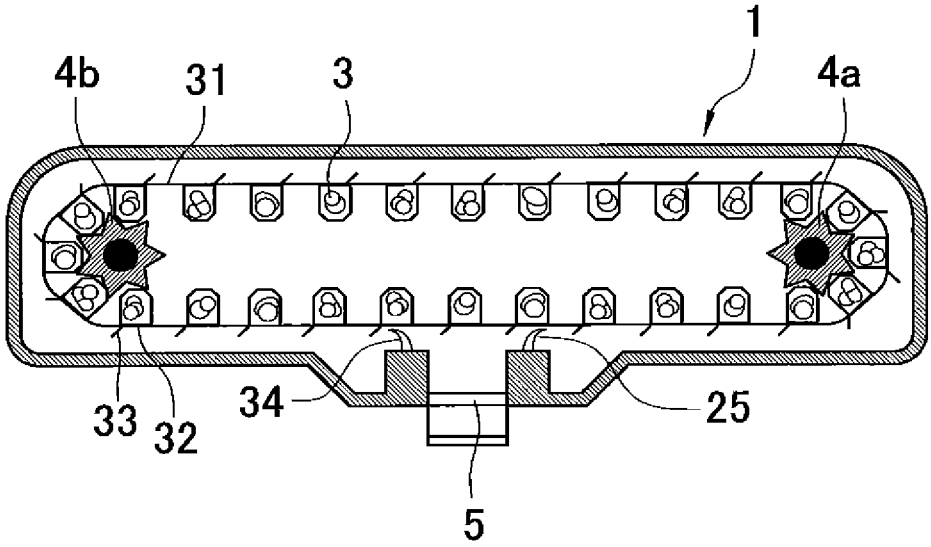

FIG. 8 is a detail view of the configuration of the medical agent dispenser near the discharge port 5. FIG. 8 is an oblique view of the area near the discharge port 5 as seen from the inside of the main body case 1, and the drug cartridge 21 near the discharge port 5 is indicated by a dotted line in the drawing. In FIG. 8, the outer shells 3*a* of the drug cartridge 21 are not depicted, in order to make the drawing easier to understand.

As shown in FIGS. 7*b* and 8, the hook 25 extends from the face on the discharge port 5 to the drug cartridge 21 side, and at about the middle its distal end is bent substantially in a right angle. The distal end of the hook 25 is formed pointing in the opposite direction from the forward feed direction of the drug cartridge 21 (to the left in the drawing) so that the distal end part of the hook 25 will catch the hole portions 24 in the tabs 23 provided to the holders 3 when the drug cartridge 21 moves from the left to the right in FIG. 8.

The operation by which the hook 25 opens the covers 22 will be described through reference to FIGS. 9*a* and 9*b* and FIGS. 10*a* to 10*f*. In Embodiment 2, the direction going from the left to the right in FIGS. 9*a* and 9*b* and FIGS. 10*a* to 10*f* will be called the forward feed direction of the drug cartridge 21, and the direction going from right to left will be called the backward feed direction of the drug cartridge 21.

FIGS. 9*a* and 9*b* schematically show the positional relation between the hole portions 24 and the hook 25 when the drug cartridge 21 is fed forward.

As shown in FIG. 9*a*, the tabs 23 are formed so as to protrude from the outer peripheral face of the drug cartridge 21, facing in the opposite direction from the forward feed direction. The hook 25 is formed so that its distal end points in the forward feed direction.

As the drug cartridge 21 is fed forward from this state, as shown in FIG. 9*b*, the tabs 23 touch the hook 25. At this point the tabs 23 come into contact with the back face of the bent portion of the hook 25, or the rear portion on the opposite side from the distal end. Accordingly, the tabs 23 do not catch on the hook 25. Therefore, as shown in FIG. 9*c*, the tabs 23 are not snagged by the hook 25, and the holders 3 pass to the other side of the hook 25.

Next, the operation by which a drug 26 is taken out of the holders 3 of the drug cartridge 21 will be described through reference to FIGS. 10*a* to 10*f*.

First, the drug cartridge 21 is fed forward, and as shown in FIG. 10*a*, the holder 3 containing the drug 26 to be discharged is moved to a position that is slightly past the hook 25 portion. The feed is started from here.

When the backward feed of the drug cartridge 21 is commenced, as shown in FIG. 10*b*, the distal end of the hook 25 catches on the hole portion 24 of the tab 23. When the backward feed is continued from this state, as shown in FIG. 10*c*, the cover 22 is peeled back from the outer peripheral face of the drug cartridge 21 in a state of being caught on the hook 25.

Once the cover 22 has been peeled back a certain amount by the hook 25 from the outer peripheral face of the drug cartridge 21, the drug 26 sealed inside the holder 3 is exposed. At this point, if the medical agent dispenser is held with the discharge port 5 facing down, as shown in FIG. 10*d*, the drug 26 falls from the holder 3 toward the discharge port 5 under the force of gravity, and is discharged from the medical agent dispenser.

The positional relation between the hook 25 and the discharge port 5 inside the medical agent dispenser, as shown in FIG. 10*d*, is such that when the cover 22 has been peeled almost entirely back from the outer peripheral face of the drug cartridge 21, the open portion of the holder 3 is located at the front of the discharge port 5.

After this, the drug cartridge 21 is again fed forward as shown in FIG. 10*e*, and when the holder 3 has moved to the right beyond the hook 25 as shown in FIG. 10*f*, the distal end of the hook 25 comes out of the hole portion 24, and the hook 25 separates from the tab 23.

When the user presses the command button 6 and a discharge command is received by the rotation controller 16, just as in Embodiment 1 above, the desired holder 3 containing the drug 26 to be discharged is moved to near the discharge port 5. After this, as shown in FIGS. 10*a* to 10*f*, the drug cartridge is fed backward and forward at a suitable timing, which discharges the drug 26 from the holder 3.

In Embodiment 2, the cover 22 can be torn back and the drug 26 inside discharged by feeding the drug cartridge 21 backward and thereby catching the distal end of the hook 25 in the hole portion 24 of the tab 23. Accordingly, when the rotation controller 16 rotates the drug cartridge 21, it rotates it in the backward feed direction only during discharge of the drug 26.

Also, when the drug cartridge 21 is mounted backward in the main body case 1, the cartridge orientation detector 9 detects that it is backward, and the rotation controller 16 displays a warning message on the display section 8 and performs control so that the gears 4*a* and 4*b* (motor) will not be rotated.

Although not depicted in the drawings, the direction detection openings 12 and the front position marks 13*a* and 13*b* are provided to the drug cartridge 21 just as in Embodiment 1. The cartridge orientation detector 9 and the cartridge front position detector 10 are also provided to the main body case 1 just as in Embodiment 1 above.

As discussed above, with Embodiment 2, there are provided an annular drug cartridge 21 in which holders 3 containing single-dose drugs 26 are linked in the lengthwise direction, and an apparatus with which this drug cartridge is rotated by the required amount to discharge the desired drug 26, and the desired drug 26 is discharged by an operation in which the drug cartridge 21 is moved.

Also, if for some reason the drug administration order should be disrupted, then just as in Embodiment 1, one or more holders 3 are skipped according to how many times the command button 6 is pressed, allowing the desired drug 26 to be discharged from the holder 3 in which it is contained.

More specifically, when the command button 6 is pressed twice, the drug cartridge 21 is fed forward by an amount equivalent to two holders 3, after which it is fed backward, allowing the desired drug 26 to be discharged from the holder 3 after the skipped position.

Consequently, even if the drug administration order is disrupted, proper discharge of the drug 26 can be carried out by adjusting the amount of forward feed of the drug cartridge 21. Also, compared to the configuration in Embodiment 1 above, there is no need for a driver for discharging the drug, such as the drug ejector 7, so the configuration of the medical agent dispenser is simplified, and the overall apparatus can be smaller.

Embodiment 3

Yet another embodiment of the present invention will now be described through reference to FIGS. 11*a* to 17*b*.

FIGS. 11*a* and 11*b* show the configuration of the medical agent dispenser in Embodiment 3. FIG. 11*a* is an oblique view of a drug cartridge 31, and FIG. 11*b* is a top cross section of the medical agent dispenser.

Embodiment 3 differs from Embodiment 2 above in that tabs 33 formed at one end of covers 32 provided to the holders 3 are in a position that is offset from the center position in the width direction of the drug cartridge 31, and a hook (second hook, discharge mechanism, opening member) 34 is provided near the discharge port 5 as a discharge mechanism (opening member).

Those components that have the same function as the members appearing in Embodiments 1 and 2 above are numbered the same and will not be described again.

As shown in FIG. 11*a*, the covers 32 are stuck on so as to block the open portion on the outer peripheral face side of the holders 3, and seal up the holders 3.

The tabs 33 are provided at a position that is offset from the center of the covers 32 in the width direction (the up and down direction in the drawings) of the drug cartridge 31, and have a shape that sticks out slightly from the outer peripheral face of the drug cartridge 31.

Other than differing in the position of the tabs 33 on the covers 32, the drug cartridge 31 in Embodiment 3 has the same configuration as the drug cartridge 21 given in Embodiment 2 above.

Figure 12:
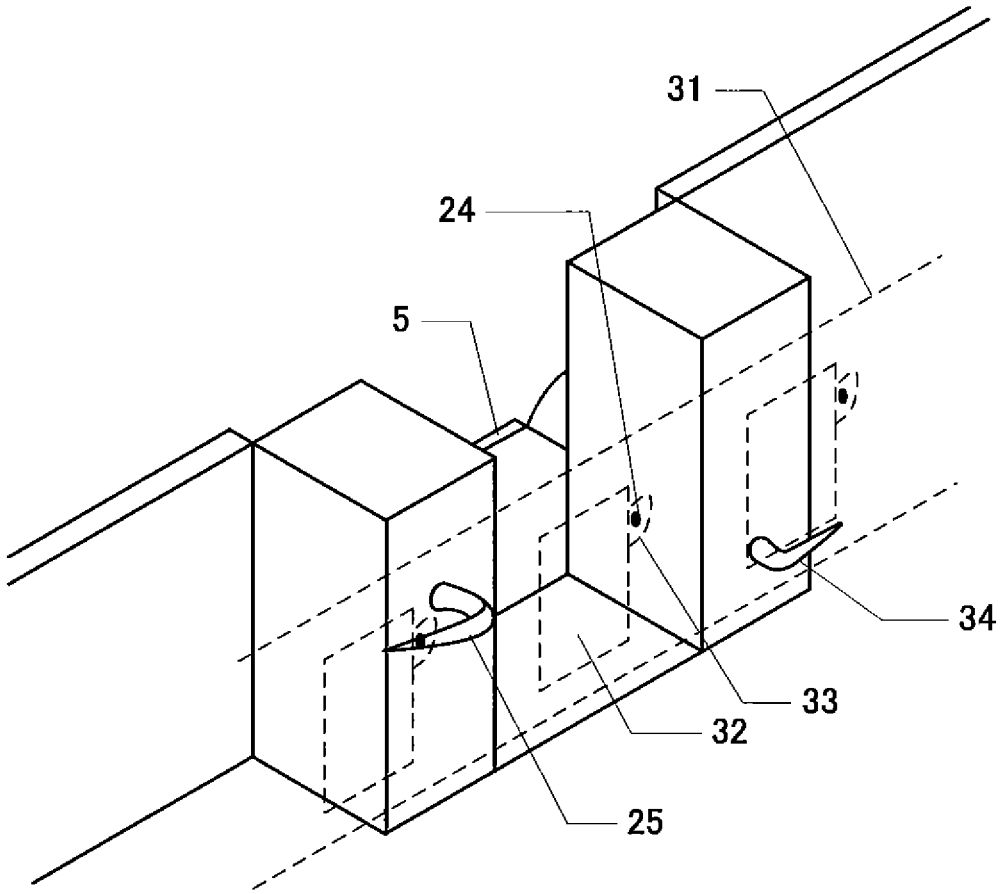
FIG. 12 is a detail oblique view of the area near the discharge port of the medical agent dispenser in FIG. 11*a;*
Figure 13:
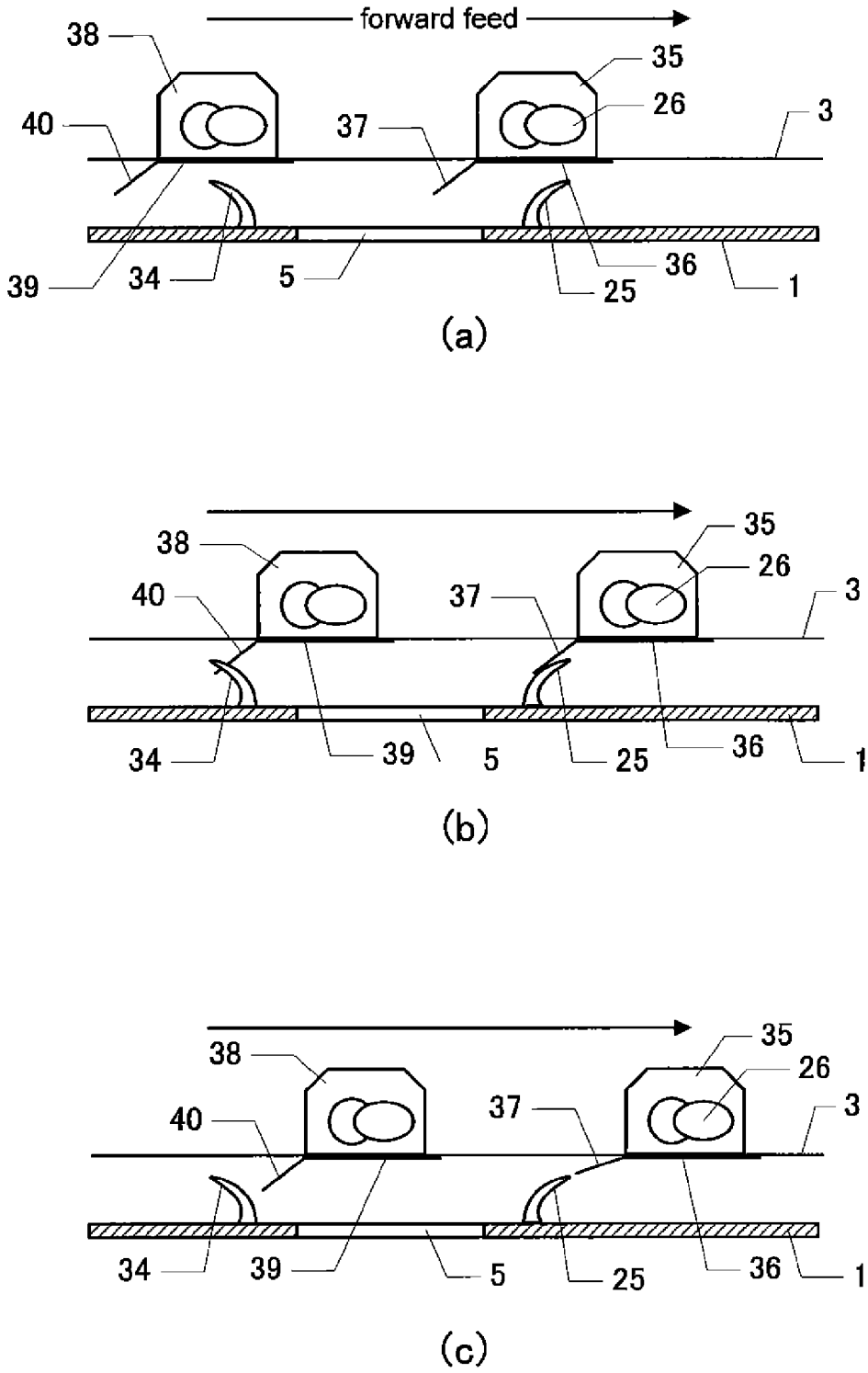
FIGS. 13*a* to 13*c* are diagrams illustrating the relation between the hook of the medical agent dispenser and the covers of the drug cartridge.
Figure 14:
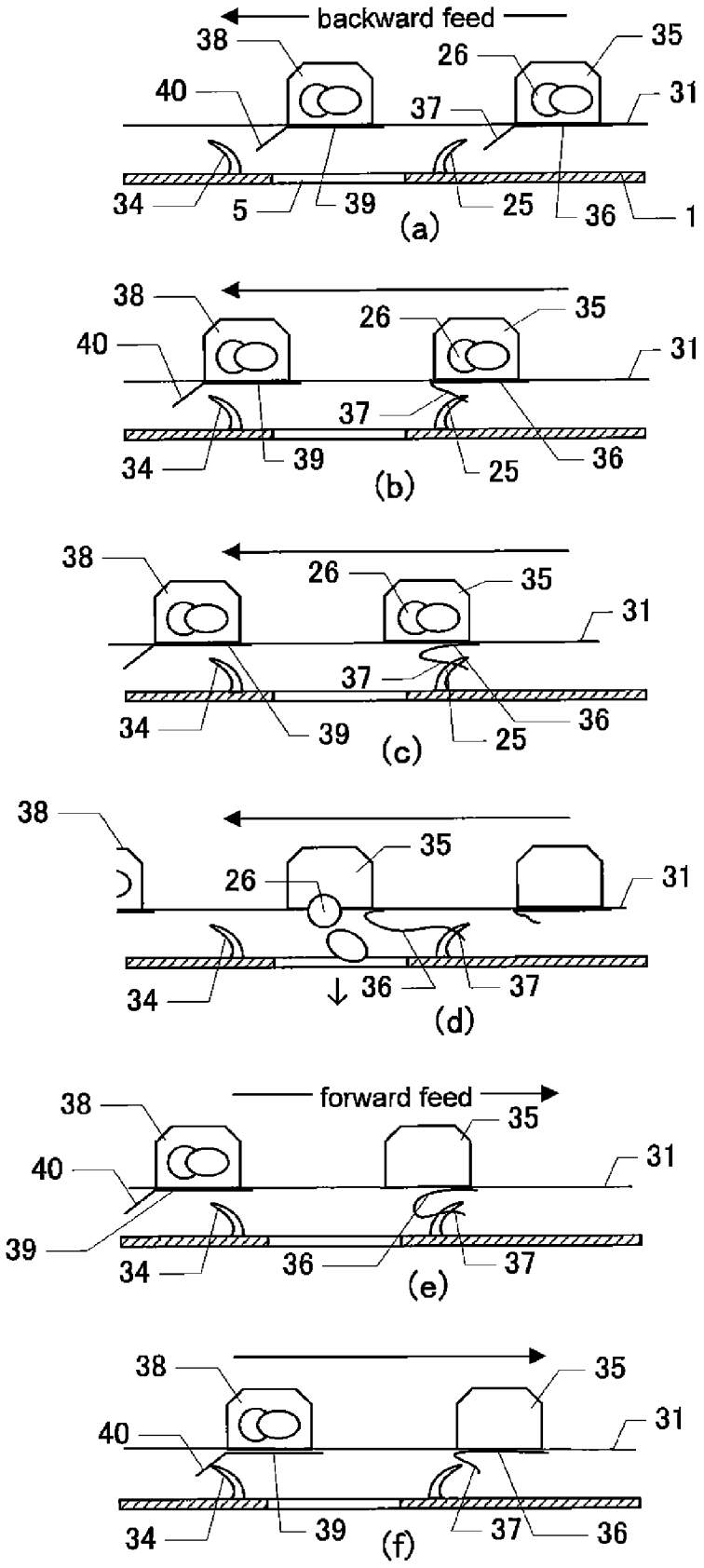
FIGS. 14*a* to 14*f* are diagrams illustrating the relation between the hook of the medical agent dispenser and the covers of the drug cartridge.
Figure 15:
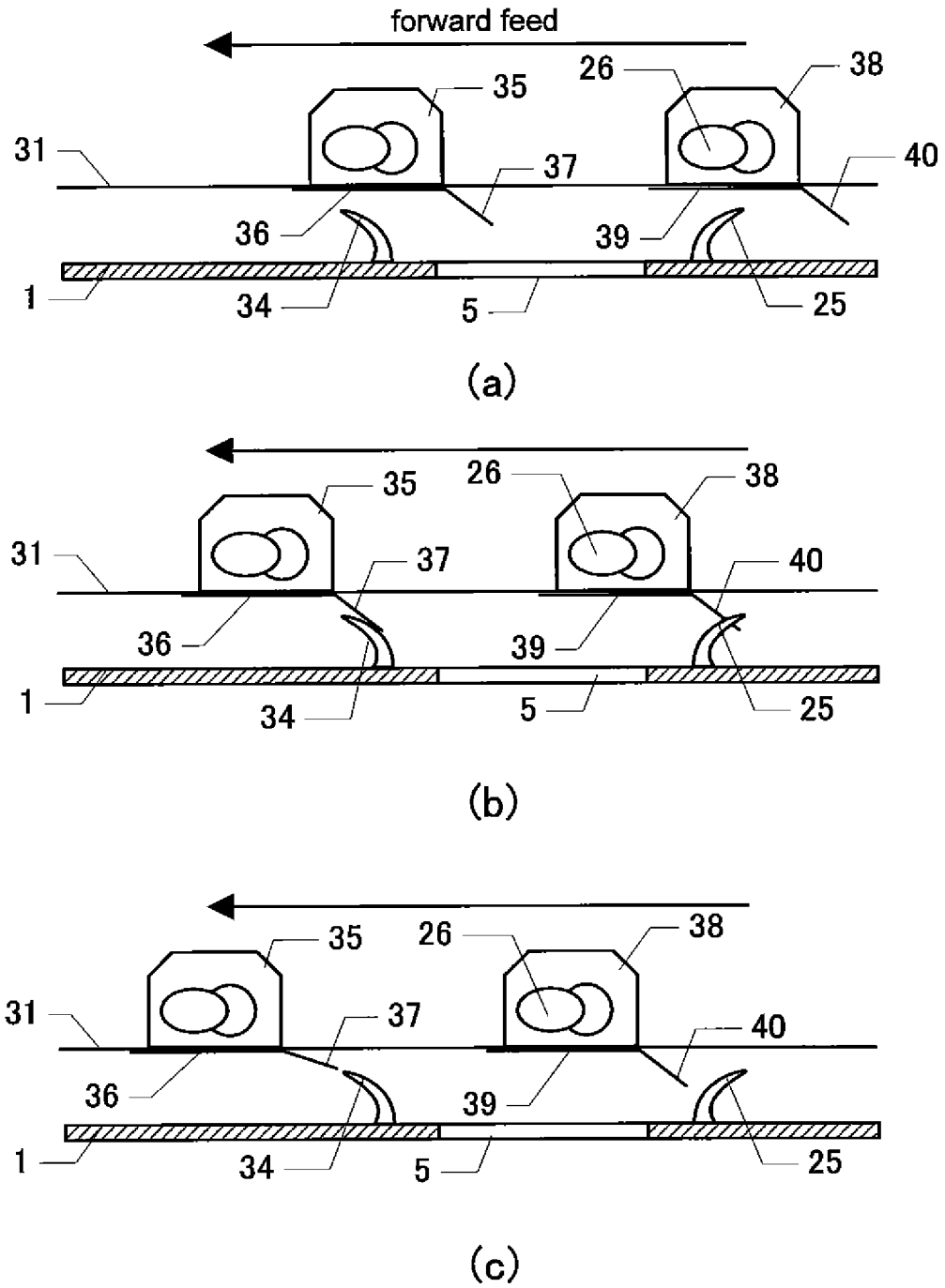
FIGS. 15*a* to 15*c* are diagrams illustrating the relation between the hook of the medical agent dispenser and the covers of the drug cartridge.
Figure 16:
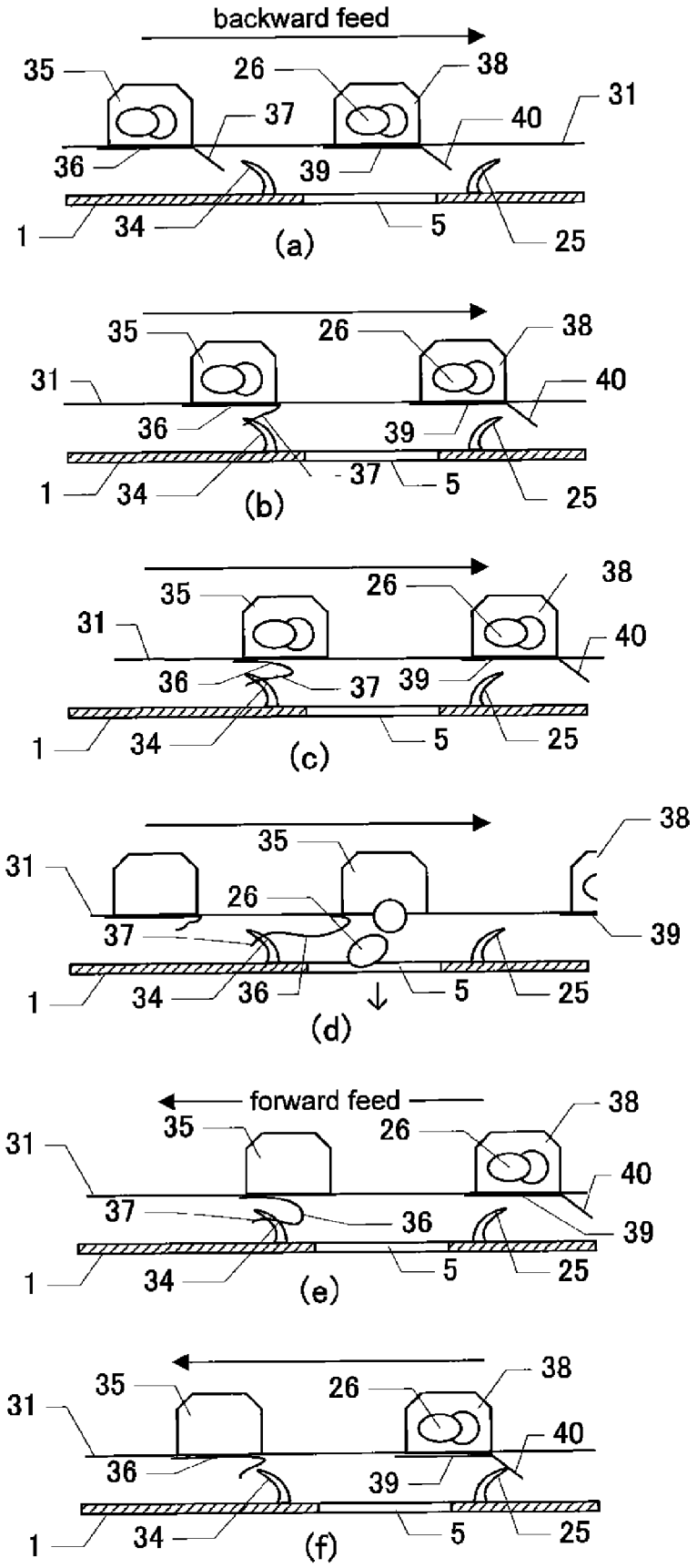
FIGS. 16*a* to 16*f* are diagrams illustrating the relation between the hook of the medical agent dispenser and the covers of the drug cartridge.
Figure 17:
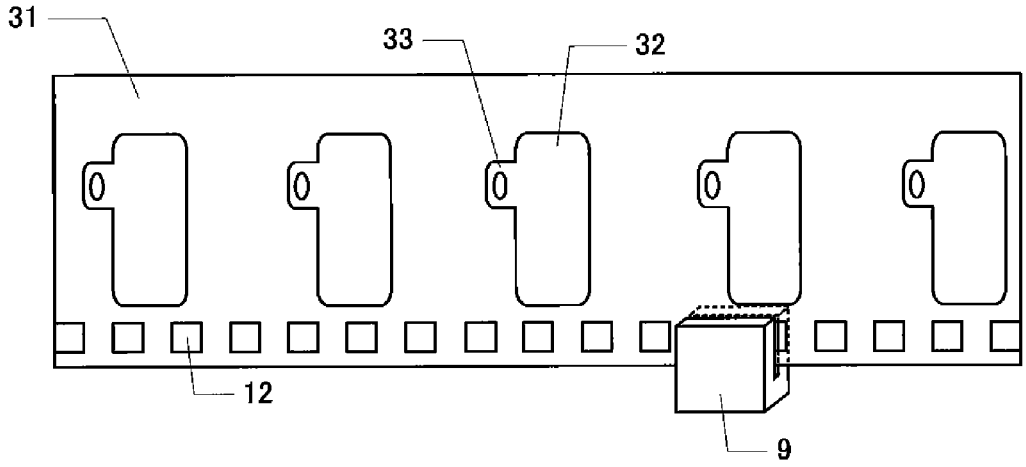
FIGS. 17*a* and 17*b* are diagrams illustrating the feed direction of the drug cartridge.
Figure 17:
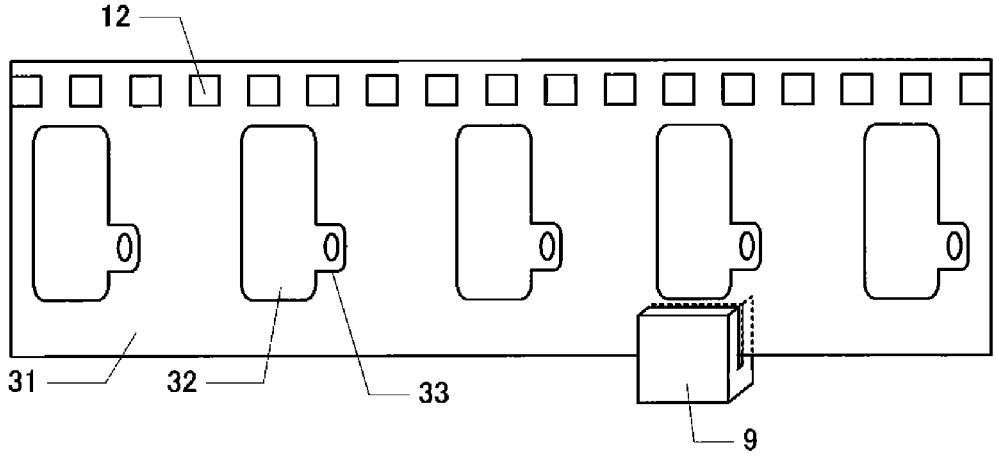

FIG. 12 is a detail view of the configuration of the drug cartridge 31 near the discharge port 5. FIG. 12 is a diagram of the area near the discharge port 5 as seen from inside the main body case 1, and the drug cartridge 31 near the discharge port 5 is indicated by a dotted line in the drawing. In FIG. 12, the outer shells 3*a* of the drug cartridge 31 are not depicted, in order to make the drawing easier to understand.

As shown in FIGS. 11*b* and 12, the hook 25 and the hook 34 extend from a face on the discharge port 5 side to the drug cartridge 31 side, and at about the middle the distal ends are bent substantially in a right angle. The distal ends of the hooks 25 and 34 point in mutually opposite directions, with the hook 25 pointing to the left in FIG. 12 and the hook 34 pointing to the right. Further, as shown in FIG. 12, the hook 25 and the hook 34 are at different positions in the vertical direction (the up and down direction in FIG. 12). These positions are separated by an equal distance in the width direction from the center in the width direction (the up and down direction in FIG. 12) of the drug cartridge 31 installed in the medical agent dispenser.

Specifically, when the drug cartridge 31 is installed in the medical agent dispenser such that its tabs 33 are higher than the center position of the drug cartridge 31 in its width direction, the hook 25 and the tabs 33 are disposed at the same height. Conversely, when the drug cartridge 31 is installed in the medical agent dispenser such that its tabs 33 are lower than the center position of the drug cartridge 31 in its width direction, the hook 34 and the tabs 33 are disposed at the same height.

The operation by which the hook 25 and the hook 34 open the covers 32 will be described through reference to FIGS. 13*a* to 14*f*.

As shown in FIG. 12, the drug cartridge 31 is inserted with the tabs 33 facing upward, that is, with the tabs 33 at the same height as the hook 25. Here, the rotational movement of the drug cartridge 31 from the left to the right side in FIGS. 13*a* to 14*f* will be called forward feed, and movement in the opposite direction will be called backward feed.

When the drug cartridge 31 is fed forward from the state in FIG. 13*a*, as shown in FIG. 13*b*, a tab 37 of a holder 35 and a tab 40 of a holder 38 move to positions opposite the hook 25 and the hook 34. At this point, the tab 37 and the hook 25 are located at the same height, so they come into contact. However, since the distal end of the hook 25 is pointing in the same direction as the feed direction of the drug cartridge 31, the distal end portion of the hook 25 does not catch in the hole portion 24 of the tab 37. On the other hand, the tab 40 and the hook 34 are at different height positions, so they pass each other without coming into contact. Therefore, as shown in FIG. 13*c*, a cover 36 and a cover 39 move in the forward feed direction without being unsealed.

The backward feed of the drug cartridge 31 is then commenced from the position shown in FIG. 14*a*. When the backward feed of the drug cartridge 31 begins, first, as shown in FIG. 14*b*, the distal end of the hook 25 catches the hole portion 24 in the tab 37. When backward feed is continued from this state, as shown in FIG. 14*c*, the cover 36 is pulled by the hook 25 and is peeled back from the outer peripheral face of the drug cartridge 31.

Once the cover 36 has been peeled back a certain amount from the outer peripheral face of the drug cartridge 31, the drug 26 is exposed. At this point, if the medical agent dispenser is held with the discharge port 5 facing down, as shown in FIG. 14*d*, the drug 26 falls from the holder 35 toward the discharge port 5 under the force of gravity, and is discharged from the medical agent dispenser.

The positional relation between the hook 25 and the discharge port 5 inside the medical agent dispenser, as shown in FIG. 14*d*, is such that when the cover 36 has been peeled almost entirely back from the outer peripheral face of the drug cartridge 31, the open portion of the holder 35 is located at the front of the discharge port 5.

After the drug 26 has been discharged, the rotation direction of the drug cartridge 31 is switched back to forward feed as shown in FIG. 14*e*. Then, as shown in FIG. 14*f*, the distal end of the hook 25 separates from the hole portion 24 at the point when the holder 35 has gone by the opposing face of the hook 25. At this point the tab 40 of the holder 38, which is adjacent downstream in the forward feed direction to the holder 35 from which the drug 26 was discharged, moves to near the hook 34, but as mentioned above, the tab 40 and the hook 34 are at different height positions. Thus, the distal end of the hook 34 does not catch the tab 40 and unseal the cover 39 of the holder 38 containing the drug that is not supposed to be discharged at this point.

Next, a case in which the drug cartridge 31 is inserted in the opposite orientation from that in FIG. 12, that is, with the tab 37 and the hook 34 at the same height positions, will be described through reference to FIGS. 15*a* to 16*f*. Here, movement of the drug cartridge 31 from the right to the left side in FIGS. 15*a* to 16*f* will be called forward feed, and movement in the opposite direction will be called backward feed.

When the drug cartridge 31 is fed forward from the state in FIG. 15*a*, as shown in FIG. 15*b*, the tab 37 of the holder 35 and the tab 40 of the holder 38 move to positions opposite the hook 25 and the hook 34. At this point, the tab 37 and the hook 34 are located at the same height, so they come into contact. However, since the distal end of the hook 34 is pointing in the same direction as the feed direction of the drug cartridge 31, the distal end portion of the hook 34 does not catch in the hole portion 24 of the tab 37. On the other hand, the tab 40 and the hook 25 are at different height positions, so they pass each other without coming into contact. Therefore, as shown in FIG. 15*c*, the cover 36 and the cover 39 move in the forward feed direction without being unsealed.

The backward feed of the drug cartridge 31 is then commenced from the position shown in FIG. 16*a*. When the backward feed of the drug cartridge 31 begins, first, as shown in FIG. 16*b*, the distal end of the hook 34 catches the hole portion 24 in the tab 37. When backward feed is continued from this state, as shown in FIG. 16*c*, the cover 36 is pulled by the hook 34 and is peeled back from the outer peripheral face of the drug cartridge 31.

Once the cover 36 has been peeled back a certain amount from the drug cartridge 31, the drug 26 is exposed. At this point, if the medical agent dispenser is held with the discharge port 5 facing down, as shown in FIG. 16*d*, the drug 26 falls from the holder 35 toward the discharge port 5 under the force of gravity, and is discharged from the medical agent dispenser.

The positional relation between the hook 34 and the discharge port 5 inside the medical agent dispenser, as shown in FIG. 16*d*, is such that when the cover 36 has been peeled almost entirely back from the outer peripheral face of the drug cartridge 31, the open portion of the holder 38 is located at the front of the discharge port 5.

After the drug 26 has been discharged, the rotation direction of the drug cartridge 31 is switched back to forward feed as shown in FIG. 16*e*. Then, as shown in FIG. 16*f*, the hook 34 separates from the hole portion 24 at the point when the holder 35 has gone by the opposing face of the hook 34.

At this point the tab 40 of the holder 38 moves to near the hook 25, but as mentioned above, the tab 40 and the hook 25 are at different height positions. Thus, the distal end of the hook 25 does not catch the tab 40 and unseal the cover 39 of the holder 38 containing the drug that is not supposed to be discharged at this point.

If the user should for some reason skip one dose, then just as in Embodiments 1 and 2, one or more holders 35 and 38 are skipped according to how many times the command button 6 is pressed, allowing the desired drugs 26 to be discharged from the holders 35 and 38 in which they are contained.

More specifically, when the command button 6 is pressed twice, the drug cartridge 31 is fed forward by an amount equivalent to two holders 35, etc., after which it is fed backward, allowing the desired drug 26 to be discharged from the holder 35, etc., after the skipped position.

Next, the specification of forward feed and backward feed in the medical agent dispenser of this embodiment will be described.

The medical agent dispenser in Embodiment 3, just as in Embodiment 1 above, comprises the cartridge orientation detector 9 and the cartridge front position detector 10. The drug cartridge 31 is also provided with the direction detection openings 12 and the front position marks 13*a* and 13*b*.

The method for specifying the feed direction of the drug cartridge 31 will now be described through reference to FIGS. 17*a* and 17*b*. The cartridge front position detector 10 and the front position marks 13*a* and 13*b* are not depicted in FIGS. 17*a* and 17*b*.

In FIGS. 17*a* and 17*b*, the direction in which the drug cartridge 31 is installed in the medical agent dispenser is different. For example, when the drug cartridge 31 is installed in the direction shown in FIG. 17*a*, the operation of rotationally moving the drug cartridge 31 from the left to the right side in the drawing becomes forward feed. On the other hand, when the drug cartridge 31 is installed in the direction shown in FIG. 17*b*, the operation of rotationally moving the drug cartridge 31 from the right to the left side in the drawing becomes forward feed.

Specifically, when the cartridge orientation detector 9 has detected the direction detection openings 12 by the method described in Embodiment 1 above, the cartridge feed direction decision section 15 can recognize an orientation of left to right as the forward feed direction, and when no direction detection openings 12 can be detected, an orientation of right to left can be recognized as the forward feed direction.

As discussed above, with the medical agent dispenser of Embodiment 3, there are provided an annular drug cartridge 31 in which holders 35 and 38 containing single-dose drugs 26 are disposed in the lengthwise direction, and an apparatus with which this drug cartridge is rotated by the required amount to discharge the desired drug 26, and the desired drug 26 is discharged by moving the drug cartridge 31 according to how many times the command button 6 has been pressed.

Consequently, even if the administration order of the drug 26 is disrupted, the proper drug 26 can be discharged. Also, compared to the configuration in Embodiment 1 above, there is no need for a driver for discharging the drug (drug ejector 7), so the configuration is simplified and the overall apparatus can be smaller.

Furthermore, no matter which way the drug cartridge 31 is facing when it is installed, the covers 36 and 39 of the holders 35 and 38 can still be unsealed, which makes the product more convenient to use.

INDUSTRIAL APPLICABILITY

With the medical agent dispenser pertaining to the present invention, the proper drug can be discharged even if the drug administration order should be disrupted, so this medical agent dispenser is useful as a way to manage drug dosage and so forth in the home as well as in medical facilities.

REFERENCE SIGNS LIST

1 main body case
1*a* upper shell
1*b* lower shell
2 drug cartridge
3 holder
3*a* outer shell
3*b* linking portion
3*c* sealing film
4*a*, 4*b* gear
5 discharge port
6 command button (input interface)
7 drug ejector (discharge mechanism)
8 display section
9 cartridge orientation detector
9*a* light emitter
9*b* light receiver
9*c* orientation determination section
9*d* orientation determination controller
10 cartridge front position detector
10*a* detector switch
11 drug cartridge
12 direction detection opening
13*a*, 13*b* front position mark
14 front holder
15 cartridge feed direction decision section
16 rotation controller (controller, discharge mechanism)
21 drug cartridge
22 cover
22*a* end
23 tab
24 hole portion
25 hook (first hook, discharge mechanism, opening member)
26 drug
31 drug cartridge
32 cover
33 tab
34 hook (second hook, discharge mechanism, opening member)
35 holder
36 cover
37 tab
38 holder
39 cover
40 tab

The invention claimed is:

1. A medical agent dispenser, comprising:

a main body case;

a discharge mechanism configured to discharge the desired drug from one of a plurality of holders that hold drugs and are disposed equally spaced in the lengthwise direction of an annular drug cartridge installed inside the main body case;

a rotation mechanism configured to rotationally move the annular drug cartridge;

an input interface that is operated to bring about drug discharge processing by the discharge mechanism; and a controller configured to control the rotational movement of the drug cartridge on the basis of number of times the input interface is operated;

wherein the main body case has a discharge port for discharging the drug, the rotation mechanism has gears that engages with the holder and rotationally move the drug cartridge, the input interface has a command button for directing the discharge of the drug, and when a drug discharge command is inputted at the command button, the controller rotates the gears to rotationally move the drug cartridge and moves the holder containing the drug to be discharged to the position corresponding to the discharge port.

2. The medical agent dispenser according to claim 1, wherein the discharge mechanism has an opening member that is provided at a position opposite the drug cartridge on the inner wall side of the main body case, and that opens covers provided to the corresponding holders on the outer peripheral face side of the annular drug cartridge.

3. The medical agent dispenser according to claim 2, wherein the opening member has a first hook having a shape that hooks into a hole portion of a tab having the hole portion in its approximate center and formed at one end of the cover.

4. The medical agent dispenser according to claim 3, wherein the first hook is oriented so that its distal end hooks the hole portion when the feed of the drug cartridge is reversed from the forward direction.

5. The medical agent dispenser according to claim 3, wherein the first hook is disposed at a position opposite the tab, which is disposed at a position offset in the end direction from the center of the annular drug cartridge in the width direction thereof.

6. The medical agent dispenser according to claim 5, wherein the opening member has a first hook and a second hook that flank a portion opposite the center of the annular drug cartridge in its width direction, and the first and second hooks are disposed with their distal ends in mutually opposite orientations in the lengthwise direction of the annular drug cartridge.

7. A medical agent dispenser, comprising:

a main body case;

a discharge mechanism configured to discharge the desired drug from one of a plurality of holders that hold drugs and are disposed equally spaced in the lengthwise direction of an annular drug cartridge installed inside the main body case;

a rotation mechanism configured to rotationally move the annular drug cartridge;

an input interface that is operated to bring about drug discharge processing by the discharge mechanism; and a controller configured to control the rotational movement of the drug cartridge on the basis of number of times the input interface is operated;

wherein the discharge mechanism has a drug ejector that is provided at a position opposite the discharge port provided to the main body case, presses the holder from the inner peripheral side of the drug cartridge in conjunction with the opening and closing operation of the discharge port or the command button, and discharges the drug contained in the holder to the discharge port.

8. A medical agent dispenser, comprising:

a main body case;

a discharge mechanism configured to discharge the desired drug from one of a plurality of holders that hold drugs and are disposed equally spaced in the lengthwise direction of an annular drug cartridge installed inside the main body case;

a rotation mechanism configured to rotationally move the annular drug cartridge;

an input interface that is operated to bring about drug discharge processing by the discharge mechanism;

a controller configured to control the rotational movement of the drug cartridge on the basis of number of times the input interface is operated;

a cartridge orientation detector configured to detect the mounting direction of the drug cartridge with respect to the main body case;

a cartridge feed direction decision section configured to decide whether to feed the drug cartridge forward or backward on the basis of the result detected by the cartridge feed direction decision section; and a rotation controller configured to control the rotation direction produced by the rotation mechanism on the basis of the result decided by the cartridge feed direction decision section.

9. The medical agent dispenser according to claim 8, wherein the cartridge orientation detector has:

a light emitter and a light receiver provided at mutually opposite positions flanking the drug cartridge;

an orientation determination section configured to determine the mounting direction of the drug cartridge on the basis of the light reception state of light emitted from the light emitter at the light receiver; and an orientation determination controller configured to control the light emitter, the light receiver, and the orientation determination section.

10. The medical agent dispenser according to claim 9, wherein the cartridge orientation detector further has a cartridge front position detector configured to detect the front position of the drug cartridge on the basis of the light reception state at the light receiver while the drug cartridge is being rotationally moved.

* * * * *